United States Patent [19]

Titmas

[11] Patent Number: 5,030,291

[45] Date of Patent: Jul. 9, 1991

[54] METHOD FOR CLEANING CONCENTRIC COLUMNS

[75] Inventor: James A. Titmas, Kent, Ohio

[73] Assignee: Eau-Viron Incorporated, Hudson, Ohio

[21] Appl. No.: 389,638

[22] Filed: Aug. 4, 1989

[51] Int. Cl.[5] ..... B08B 9/04

[52] U.S. Cl. ..... 134/8; 134/9; 134/14; 134/22.1; 134/22.11; 134/22.12; 15/104.03; 15/104.04; 15/104.05; 15/104.061

[58] Field of Search ..... 134/9, 14, 22.1, 22.11, 134/22.12, 8; 15/104.04, 104.03, 104.05, 104.061

[56] References Cited

U.S. PATENT DOCUMENTS 2,959,224 11/1960 Ault ..... 166/43

3,460,180 8/1969 Girard ..... 15/104.061

*Primary Examiner*—H. M. S. Sneed

*Assistant Examiner*—Zeinab El-Arini

*Attorney, Agent, or Firm*—Renner, Kenner, Greive, Bobak, Taylor & Weber

[57] ABSTRACT

A device for cleaning opposing surfaces (13, 14) of concentric columns (11, 12) is formed from a strip of material (20) configured as a spiral having inside and outside edges (21, 22) such that each edge (21, 22) forms a helix. The device (10) is utilized by introducing it between the concentric columns (11, 12). The strip (20) inside edge (21) abuts the opposing surface (13) of the inner column (11), and the outside edge (22) abuts the opposing surface (23) of the outside column (12). The device (10) is forced to travel along the lengths of the columns (11, 12) by an hydraulic fluid downflow thereby scraping deposits from the opposing surfaces (13, 14).

9 Claims, 3 Drawing Sheets

METHOD FOR CLEANING CONCENTRIC COLUMNS

TECHNICAL FIELD

The present invention generally relates to a method and apparatus for cleaning the opposing surfaces of concentric or nested columns. More particularly, the present invention pertains to a device for cleaning opposing surfaces of reactor vessels having concentric columns with reactant and product flows between the columns. In addition, the present invention relates to the method of cleaning the opposing surfaces of concentric columns whereby a device is introduced into the area between the concentric columns and is forced by hydraulic pressure to travel along the lengths of the columns thereby scraping and cleaning the opposing surfaces.

BACKGROUND ART

It is known in the art to improve certain chemical reaction kinetics by increasing the pressure and temperature at which the reaction is conducted. One method of achieving the desired conditions has been to utilize a deep well hydraulic column or gravity pressure reactor vessel, such as disclosed in U.S. Pat. Nos. 3,853,759, 4,272,383 and 4,792,408. Such reactors include a plurality of concentric or nested columns, such that an inner column and an outer column have opposing surfaces. Reactants are introduced into the areas between the columns, and a downflow is created to carry the reactants to the bottom of the reactor vessel where the reaction takes place with the resulting products of the reaction traveling upwardly between other columns.

It is known that organic growths such as algae build up on the column surfaces, especially when raw water such as river water is introduced into and heated in these reactors. Further, when water or other reactants are heated, minerals such as calcium sulphate often become deposited on the surfaces of the columns. Other reactants, contaminants and by-products such as oil and the like may also be deposited on the column surfaces.

These deposits will eventually restrict the flow between the columns, it having been found that once the deposits have built up to as little as one eighth of an inch, they must be cleaned off in order to maintain the reactor in proper operating condition. Heretofore, the cleaning of concentric column reactors has involved pre-treating the deposits with an alkali conditioner, washing the columns with an acid solution and then purging the system. Nitric acid is commonly used, which is known to be unstable and dangerous.

The reactor must be completely shut down and cooled before such cleaning takes place. It has been found that when heating waste bearing waters with normal mineral content, cleaning is needed approximately once every ten days. The cleaning process may take as long as an entire day, which means that the reactor effectively loses ten percent of its operating capacity.

Therefore, a need exists for an improvement in concentric column cleaning in general, and specifically for cleaning gravity pressure reactor vessels having concentric hydraulic columns.

DISCLOSURE OF THE INVENTION

It is, therefore, a primary object of the present invention to provide a device for cleaning deposits on the opposing surfaces of concentric columns.

It is another object of the present invention to provide a device, as above, which can be utilized to clean concentric columns in a gravity pressure reactor vessel by a method which does not require cooling the system or substantially interrupting normal system operations.

It is a further object of the present invention to provide a device, as above, which can be utilized to clean such vessels by a method which does not require the use of dangerous or caustic solutions.

These and other objects of the present invention, as well as the advantages thereof over existing art forms, which will become apparent in view of the following specification are accomplished by means hereinafter described and claimed.

In general, a surface cleaning device for concentric columns, where an inner column has an outer surface opposing an inner surface of an outer column, includes a strip of material which is configured in the shape of a spiral. The strip has an inside and an outside edge. Each edge is in the shape of a helix, and the inside edge abuts the opposing outer surface of the inner concentric column, while the outer edge abuts the opposing inner surface of the outer column.

The device may be utilized to clean a gravity pressure reactor vessel having concentric hydraulic columns which utilizes a downdraft between such columns for the introduction of reactants by wrapping the device around the outer surface of an inner column. The reactor is then allowed to operate in a normal fashion, such that the normal liquid flow causes the strip of material to travel between the concentric columns and along their length, scraping away deposits thereon.

PREFERRED EMBODIMENT FOR CARRYING OUT THE INVENTION

Figure 1:
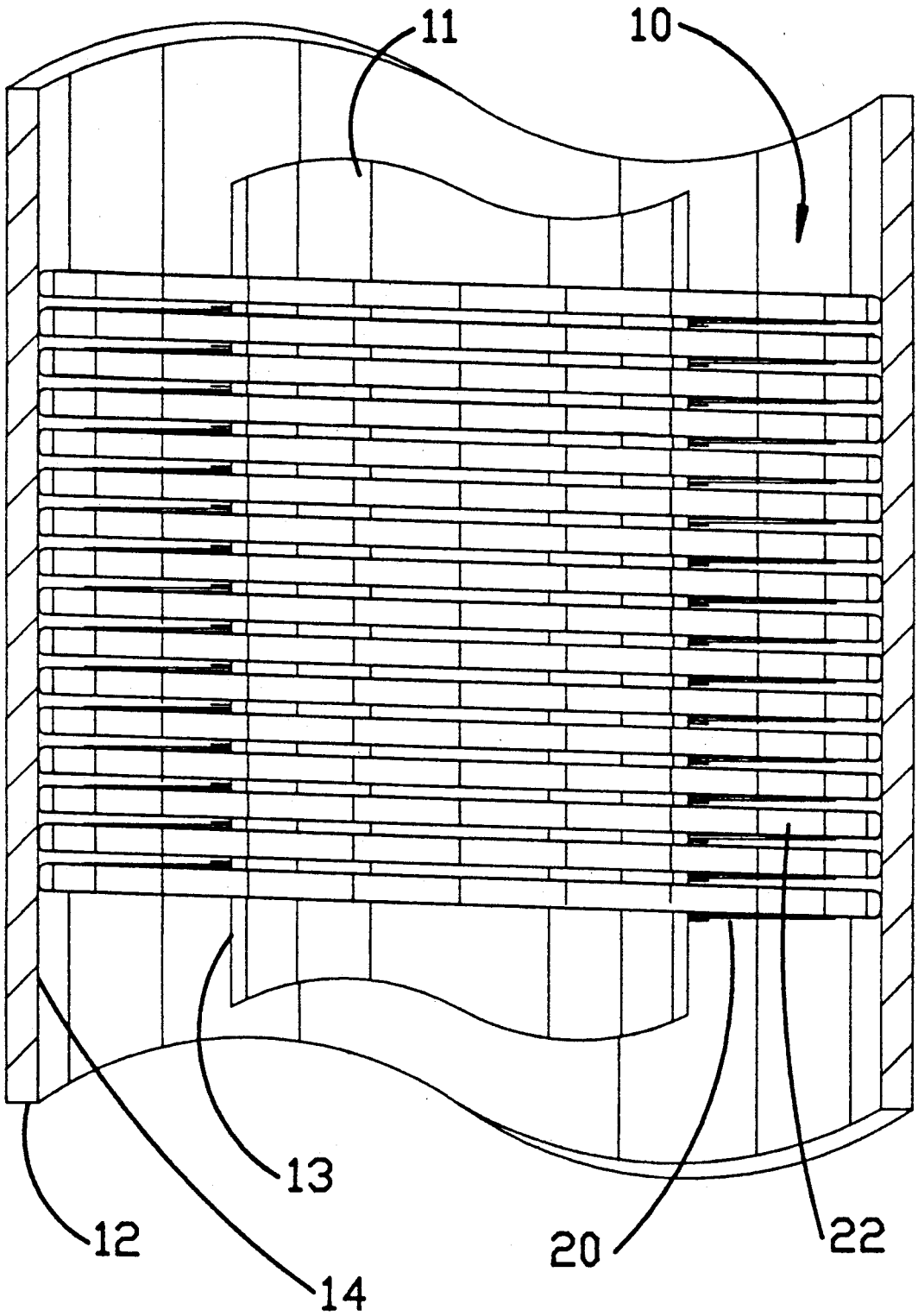
FIG. 1 is a side elevational view of a device according to the present invention, shown in place between concentric columns with the outer column shown in section.

A device for cleaning opposing surfaces of concentric columns according to the present invention is generally indicated by the numeral 10 in the drawings. A typical set of concentric columns is depicted in the drawings as including an inner column 11 and an outer column 12. Inner column 11 has an outer surface 13 opposing an inner surface 14 of outer column 12. As described above, concentric columns 11 and 12 are often employed in gravity pressure reactor vessels, and as such, are subject to mineral and waste product deposit buildup on opposing surfaces 13 and 14. The present invention is directed toward cleaning or scraping these deposits away from opposing surfaces 13 and 14.

Figure 2:
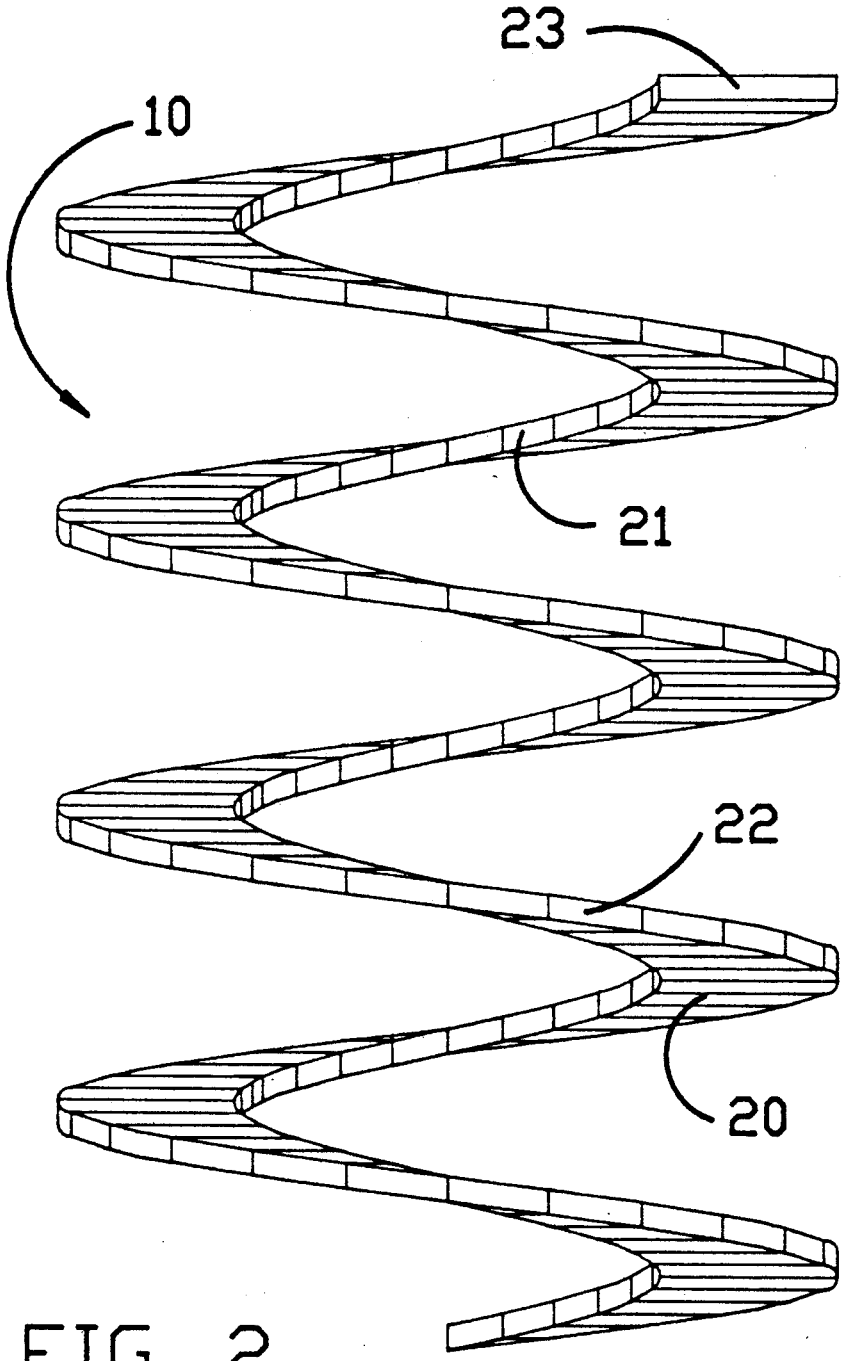
FIG. 2 is a side elevational view of the device according to the present invention shown in an expanded configuration prior to insertion between concentric columns.

As best seen in FIG. 2, device 10 is shown as being in the form of a strip of material 20 which is configured into a spiral. Strip 20 has an inside edge 21 and an outside edge 22. Both the inside edge 21 and the outside edge 22 are part of the spiral, such that each edge 21 and 22 forms a helix.

When in the stretched configuration shown in FIG. 2, such that the pitch between each helix formed by edges 21 and 22 is substantially greater than 0 degrees, it may be inserted between columns 11 and 12, and "screwed" onto inner column 11. That is, by rotating the device 10, successive portions or "coils" of the strip 20 are caused to be wrapped around the inside column 11, such that the inside edge 21 abuts against outer surface 13 of inside column 11, and the outside edge 22 abuts against inner surface 14 of outside column 12. The cross sectional dimensions of device 10 will vary according to the space between concentric columns. With the columns 11 and 12 depicted in the drawings, device 10 is shown with a generally rectangular cross section to properly abut both columns. The cross section can be seen at end 23 of strip 20 in FIG. 2. The device 10 should fit snugly between the columns 11 and 12, such that it will move only with a force applied thereto. The exact dimensions of device 10 will therefore vary according to the spacing of the columns to be cleaned, and are therefore not a limitation of the present invention.

Figure 3:
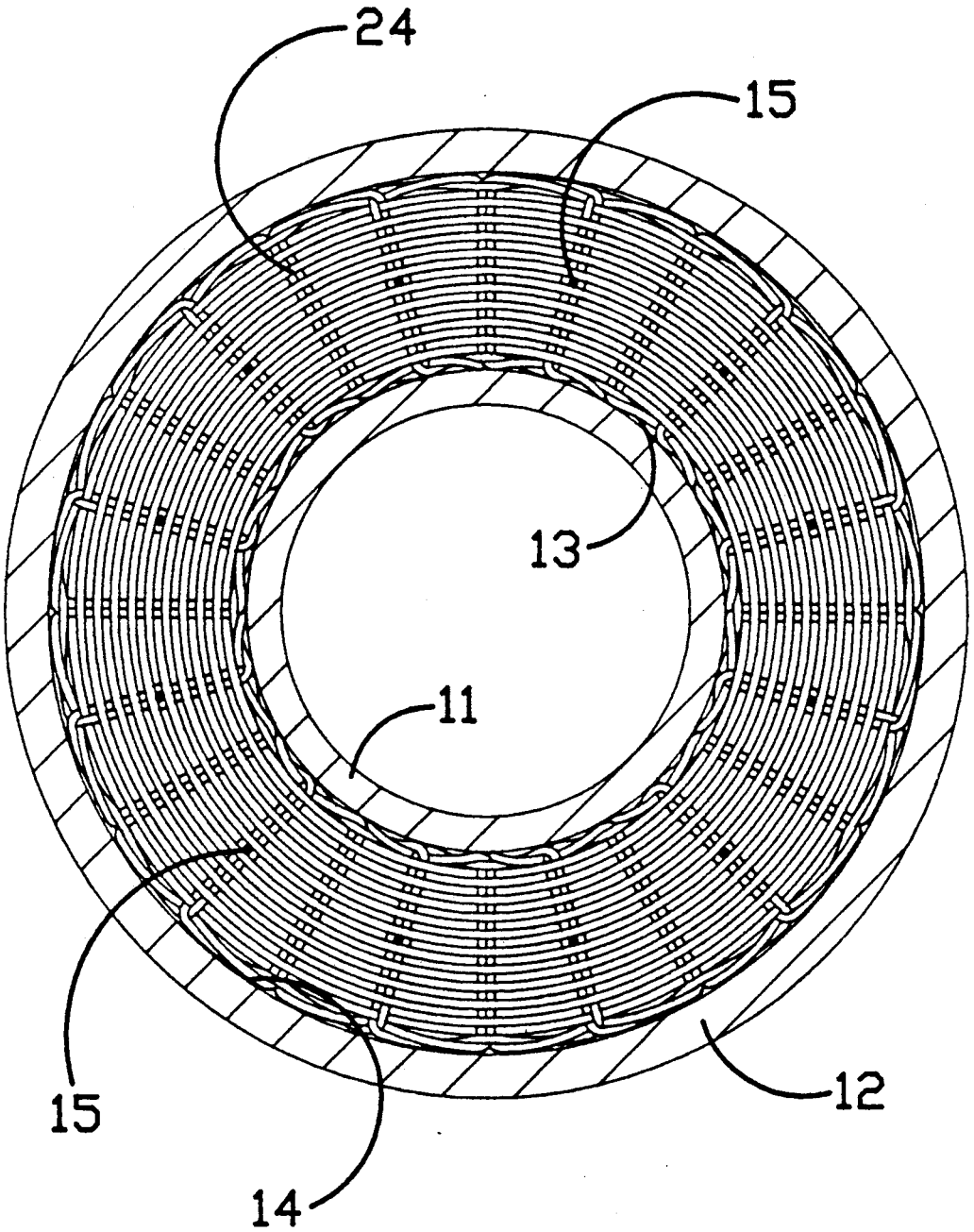
FIG. 3 is a top plan view of a device according to the present invention shown in place between concentric columns.

Strip 20 may be made of a material such as the woven wood fibers 24, as is shown in FIG. 3. Wood fibers 24 have the characteristic of decomposing readily upon exposure to moisture and high temperatures, which is an advantage of the invention as described hereinbelow. Wood fibers 24 are, however, only one example of numerous decomposable materials which may be employed without departing from the spirit of the present invention.

Once in place between columns 11 and 12, a liquid flow is forced behind the device 10, so that it is forced downwardly along the length of the columns 11 and 12. If the concentric columns are part of a gravity pressure reactor vessel, normal reactor products downflow can be employed. Thus, the reactor is allowed to operate as normal. As device 10 travels along the columns 11 and 12, it will compress, that is, the pitch between the helixes formed by edges 21 and 22 will become less. This configuration causes the fit of the device between the columns 11 and 12 to be as snug as possible, which effects maximum cleaning potential. Because the device 10 fits snugly between the columns 11 and 12, the device scrapes the opposing surfaces 13 and 14 as it travels. Making the fit even more snug, and applying more hydraulic force, causes greater scraping action. While the hydraulic force may be sufficient to compress the coils, to assure that the coils of strip 20 are compressed adjacent to each other, as shown in FIG. 1, during the downward travel, a plurality of ties 15 may be provided as shown in FIG. 3.

The hydraulic pressure is applied behind the device 10 until it travels along columns 11 and 12 to the point of temperature and pressure where the material decomposes upon exposure to moist heat as encountered in a gravity pressure reactor vessel. Such a material may be the wood fibers 24 described above, or any material having the preselected decomposure characteristics. Thus, the material can be selected such that it will decompose at the depth desired to be cleaned. In deeper reactors, therefore, the selected material would have to have a higher resistance to decomposure. Once decomposed, device 10 may then be flushed out of the system with the normal system outflow.

If desirable, a re-usable device 10 can be constructed exactly as described herein except that it would be made of a material which would not decompose at the pressures and temperatures encountered. It too would be forced down the columns as described herein but once it would reach the bottom, the hydraulic flow would be reversed so that the pressure causes the device 10 to travel back toward the area wherein it was introduced into the system. The device 10 may then be removed for storage, or held in storage within the system itself. Of course, in this instance the system would have to be temporarily shut down to accommodate the reversal, but such a shut down would not be of the extent required in prior art cleaning processes.

In addition to the advantages of the present device already described, another advantage is that minerals such as calcium sulphate, which are normal precipitates from water and other reactant streams, will be removed from the surfaces 13 and 14 and caused to be suspended in the liquid flow. It is well known that metallic salts will plate to like salts in liquid suspension more readily than with other compounds. Thus, it has been found that minerals in the liquid flow which would otherwise be deposited on the surfaces 13 and 14, are caused to plate to like minerals in the suspension. These plated minerals are then caused to be flushed to the bottom of the reactor, where they too may be removed by normal reactor outflow. These plated minerals may then be collected and reintroduced into the reactant downflow in order to further promote plating, which serves to minimize the amount of build up on the internal surfaces thereby requiring cleaning less frequently.

It has been found that gravity pressure reactor vessels are subject to most waste deposit buildup in the reactant downflow passages, and less in the product flow or recycle passages. While the present invention thus has greater application to cleaning the downflow passages, it would have equal application to cleaning the other passages as well, although cleaning may be required less often in the other passages.

Moreover, while the present invention has particular application to the cleaning of concentric columns associated with deep well gravity pressure reactor vessels, it has equal application to the cleaning of any set of concentric or nested columns, pipes, tubes and the like.

It should also be appreciated that the scrubbing action may be enhanced by sculpting inside edge 21 and outside edge 22 with grooves on a bias to provide channels for additional cutting edges.

Thus it should be evident, that a method and device for cleaning concentric columns embodying the concepts of the invention disclosed herein carries out the various objects of the invention and otherwise constitutes an advantageous contribution to the art.

I claim:

1. A method for cleaning concentric columns of a gravity pressure reactor vessel having an inner column with an outer surface opposing an inner surface of an outer column with downward hydraulic fluid flow being effected in the area between the concentric columns, comprising the steps of wrapping a strip of material which will decompose upon exposure to the moisture and heat encountered in gravity pressure vessel around the outer surface of the inner concentric column, said strip of material being configured in a spiral and having an inside and an outside edge, said inside and outside edges each being in the shape of a helix, said inside edge abutting the outer surface of the inner concentric column and said outside edge abutting the inner surface of the outer concentric column; and causing the downward hydraulic flow to force the strip of material to travel downwardly between the concentric columns toward the bottom of the reactor vessel thereby scraping the opposing surfaces.

2. A method as in claim 1, further comprising the step of decomposing the strip by exposing the strip to moist heat in the gravity pressure.

3. A method as in claim 2, further comprising the step of flushing the decomposed strip of material out of the reactor with normal reactor outflow.

4. A method as in claim 1, further comprising the step of reversing the direction of the hydraulic flow once said strip of material reaches the bottom of the reactor vessel, such that said strip of material is caused to travel upwardly between the concentric columns in a direction toward the area at which it was initially introduced into the system.

5. A method as in claim 1, whereby the step of wrapping the strip of material creates a pitch of each helix substantially greater than zero degrees.

6. A method as in claim 5 further comprising the step of compressing the pitch of each helix as the strip of material is forced between the concentric columns in the downflow.

7. A method as in claim 1, further comprising the step of allowing metallic salts scraped from the opposing surfaces of the concentric columns to be suspended in the downward hydraulic flow in order to promote like salts in plating thereto.

8. A method as in claim 7, further comprising the step of flushing the metallic salts away from the vessel with normal reactor outflow, and collecting and reintroducing the metallic salts into the reactor in order to further promote plating.

9. A method as in claim 1, wherein successive portions of the strip are employed as screw threads such that said step of wrapping a strip of material is accomplished by rotating the strip of material.

* * * * *

UNITED STATES PATENT AND TRADEMARK OFFICE

CERTIFICATE OF CORRECTION

PATENT NO. : 5,030,291

DATED : Jul. 9, 1991

INVENTOR(S) : James A. Titmas

It is certified that error appears in the above-identified patent and that said Letters Patent is hereby corrected as shown below:

Column 4, line 63, Claim 1, between the words "in gravity" insert --the--.

Column 5, line 10, Claim 2, following the word "pressure" insert --vessel--.

Signed and Sealed this

Fourth Day of May, 1993

*Attest:*

Michael K. Kirk

MICHAEL K. KIRK

*Attesting Officer*

*Acting Commissioner of Patents and Trademarks*